US006158923A

United States Patent [19]

Wheeler et al.

[11] Patent Number: 6,158,923

[45] Date of Patent: Dec. 12, 2000

[54] METHOD AND APPARATUS FOR INSTALLING SILT FENCE

[75] Inventors: Bert Wheeler, Indianapolis; Jon Scott Rhodes, Fishers; Robert Eric Abbott, Indianapolis, all of Ind.

[73] Assignee: Revoluntinary Machine and Installation LLC, Indianapolis, Ind.

[21] Appl. No.: 09/161,187

[22] Filed: Sep. 25, 1998

[51] Int. Cl.[7] ..... E02B 7/02; E01F 7/02

[52] U.S. Cl. ..... 405/116; 405/258; 256/12.5; 37/403

[58] Field of Search ..... 405/21, 258, 116; 256/12.5, 1; 37/142.5, 403

[56] References Cited

U.S. PATENT DOCUMENTS

| | | | |
|---|---|---|---|
| 3,182,459 | 5/1965 | Grether et al. | 405/115 |
| 3,332,249 | 7/1967 | Idoine | 37/142.5 |
| 3,429,386 | 2/1969 | Secrist et al. | 175/170 |
| 4,261,400 | 4/1981 | Spence | 144/193 A |
| 4,475,604 | 10/1984 | Albertson et al. | 175/85 |
| 4,660,479 | 4/1987 | Crisio, Jr. et al. | 111/2 |
| 4,720,212 | 1/1988 | Steenbergen et al. | 405/176 |
| 4,825,569 | 5/1989 | Porter | 37/142.5 |
| 5,108,224 | 4/1992 | Cabaniss et al. | 405/52 |
| 5,490,568 | 2/1996 | Rios et al. | 173/42 |
| 5,553,807 | 9/1996 | Lopez | 242/557 |
| 5,685,668 | 11/1997 | Justice | 405/267 |

OTHER PUBLICATIONS

"Tommy Silt Fence Machine Website" May 7, 1998, http://www.tommy–sfm.com.

"Silt Fence" May 7, 1998, http://www.ad–corp.com.

*Primary Examiner*—Eileen D. Lillis
*Assistant Examiner*—Gary S. Hartmann
*Attorney, Agent, or Firm*—Locke Reynolds LLP

[57] ABSTRACT

An apparatus for installing a preassembled silt fence into soil and mountable to a vehicle, including a holder mountable to the vehicle and capable of holding a roll of preassembled silt fence for unrolling rotation, a trenching member mountable to the vehicle for cutting a trench in the soil as the vehicle travels, a guide mountable to the vehicle proximate to the holder for guiding unrolled silt fence at least partially into the trench as the vehicle travels, a stake ram mountable to the vehicle proximate to the guide for driving stakes of the preassembled silt fence into the soil at the trench, and means for activating the stake ram when each stake reaches a predetermined position. A method for installing preassembled silt fence into soil, including mounting a roll of preassembled silt fence to a vehicle for unrolling rotation, rotating the roll to unroll silt fence by a length generally equivalent to a distance traveled by the vehicle, cutting a trench in the soil proximate to unrolled silt fence with a trenching member mounted to the vehicle as the vehicle travels, feeding at least a portion of the unrolled silt fence into the trench as the vehicle travels, and driving stakes of the preassembled silt fence into the soil at the trench with a stake ram mounted to the vehicle as the vehicle travels, so that the silt fence is installed generally vertically in the soil and at least partially within the trench.

17 Claims, 10 Drawing Sheets

METHOD AND APPARATUS FOR INSTALLING SILT FENCE

BACKGROUND OF THE INVENTION

1. Field of the Invention

This invention relates generally to methods and apparatus for installing fencing into soil, and more particularly relates to methods and apparatus for installing preassembled, rolled silt fence at least partially into a trench cut into soil.

2. Description of the Prior Art

Silt fence became widely used in the late 1970s, as a result of increased awareness that on construction sites, heavy rain can cause large amounts of sediment to be discharged into creeks and waterways. Recently, the use of silt fence has increased rapidly. It is estimated that each year, 200 million feet are installed nationally. Silt fence installation started with building contractors performing installation themselves. As this job became overwhelming, contractors started turning to silt fence installation subcontractors for help, however, silt fence was still installed by hand.

Silt fence is typically comprised of an approximately 90 cm wide geotextile fabric, attached at 1.5 to 3 m intervals to wood stakes using staples. The fabric and attached stakes are rolled up and shipped to a jobsite. At the jobsite, an approximately 15 cm deep by approximately 10 cm wide trench is dug into the soil. The fabric is rolled out, and the stakes are stood up and driven into the ground by hand using a sledgehammer, with the bottom 15 cm of the fabric disposed in the bottom of the trench. The trench is then backfilled with soil, by hand using a shovel, so that water cannot flow under the fence. When water flows to the fence, it is filtered through the fabric, thereby retaining sediment on the jobsite.

There exists a need in the art for methods and apparatus for installing silt fence which greatly decrease the amount of labor required for installation, and greatly increase the rate at which such fencing can be installed.

SUMMARY OF THE INVENTION

In order to aid in the understanding of the present invention, it can be stated in essentially summary form that it is directed to methods and apparatus for installing preassembled, rolled silt fence at least partially into a trench cut into soil.

More specifically, the apparatus of the present invention is directed to an apparatus for installing silt fence capable of attachment to a tractor, where typically, silt fence is preassembled into a roll and formed of a geotextile fabric with attached stakes. The apparatus includes an end plate mountable to the rear portion of the tractor, and a pair of generally parallel guide plates slidably mounted generally perpendicular to the end plate for reciprocating movement. The guide plates are mounted together with a separator, defining therebetween a guide slit. Movement of the guide plates is controlled by a pair of hydraulic cylinders mounted to the end plate and to a guide cross member, and hydraulically connected to the hydraulic system of the tractor. A silt fence roll holder is mounted to one guide plate and includes a holder base, at least a pair of curved arm holders, a shorter wall, and a higher wall. The holder is mounted to the guide plate proximate to a rectangular aperture defined through the guide plate so that an axis defined by a silt fence roll mounted to the roll holder is generally vertical, and unrolled silt fence may move through the aperture and into guide slit. A trenching member is mounted to and between the lower portions of the guide plates, near the end plate. A backfill blade is slidably mounted to the lower portion of each of the guide plates, distal from the end plate and the plow blade. During backfilling of trenched soil, proper vertical height of the backfill blades are maintained by a wheel mounted to each blade, and movement of the backfill blades is damped by shock absorbers.

As silt fence unrolls and moves through the guide slit, the attached stakes reach a position with respect to the guide plate proximate to a notch defined by the guide plate. A stake ram is mounted to and between the guide plates at the notch, for reciprocating movement of a stake ram base mounted to a hydraulic stake ram cylinder. The stake ram cylinder is hydraulically connected to a hydraulic accumulator, which is hydraulically connected to the hydraulic system of the tractor. Actuation of the stake ram cylinder is accomplished using a fused push button assembly electrically connected to a tractor battery and to a solenoid. Speed of operation of the stake ram cylinder is increased by use of an accumulator disposed in hydraulic connection with the stake ram cylinder.

Each stake may be directly positioned beneath the stake ram base for insertion into the soil using a stake positioner rotatably mounted to a guide plate. The stake positioner includes a positioner shaft rotatably disposed in a mounting tube, with a shaft handle attached to the upper end of the shaft and a pair of spaced-apart positioning arms projecting from the shaft. By rotation of the shaft handle, the positioning arms rotate into the guide slit, thereby holding a stake generally vertically and directly beneath the stake ram base.

In use, the tractor is moved to a location where silt fence is to be installed, with the guide plates, trenching member and backfill blades disposed in a retracted, relatively elevated position. Upon arriving at the desired location, the hydraulic cylinders are activated causing the guide plates and the trenching member to move downward so that the trenching member is inserted into the soil to create the trench. A preassembled roll of silt fence is then placed onto the roll holder, and the silt fence is unrolled and fed through the aperture and between the guide plates to trail-out behind the tractor. As the tractor travels, a trench is cut by the trenching member and silt fence is laid into the trench. When a stake, attached to the unrolling fabric, reaches a position just below the stake ram, the shaft handle is rotated to a blocking position so that the positioning arms block the guide silt with respect to further rearward movement of the stake. The push button assembly is then pressed, triggering the solenoid to rapidly activate the stake ram, forcing the stake generally downward into the soil. Thereafter, the stake ram retracts and the shaft handle is returned to its original position. Additional silt fence is permitted to trail-out behind the tractor as the tractor travels and the roll rotates within the roll holder. As succeeding stakes become positioned below the stake ram, each stake is inserted into the soil. The soil displaced from the trench may be backfilled after installation of the silt fence, by action of the backfill blades.

In a second embodiment of the apparatus of the present invention, the roll holder may further include a rotatable carrier having a spindle disposed in the holder base. The carrier is rotatable with respect to the holder base about an axis defined by the spindle, so that a roll of silt fence may be placed on the carrier over the spindle, for easy rotation of the roll and unrolling of the silt fence as the tractor travels.

Further features and advantages of the present invention will be apparent from a study of the following portion of the specification, the claims, and the attached drawings.

DESCRIPTION OF THE PREFERRED EMBODIMENTS

The following portion of the specification, taken in conjunction with the drawings, sets forth the preferred embodiments of the present invention. The embodiments of the invention disclosed herein are the best mode contemplated by the inventors for carrying out the invention in a commercial environment, although it should be understood that various modifications can be accomplished within the parameters of the present invention.

Figure 1:
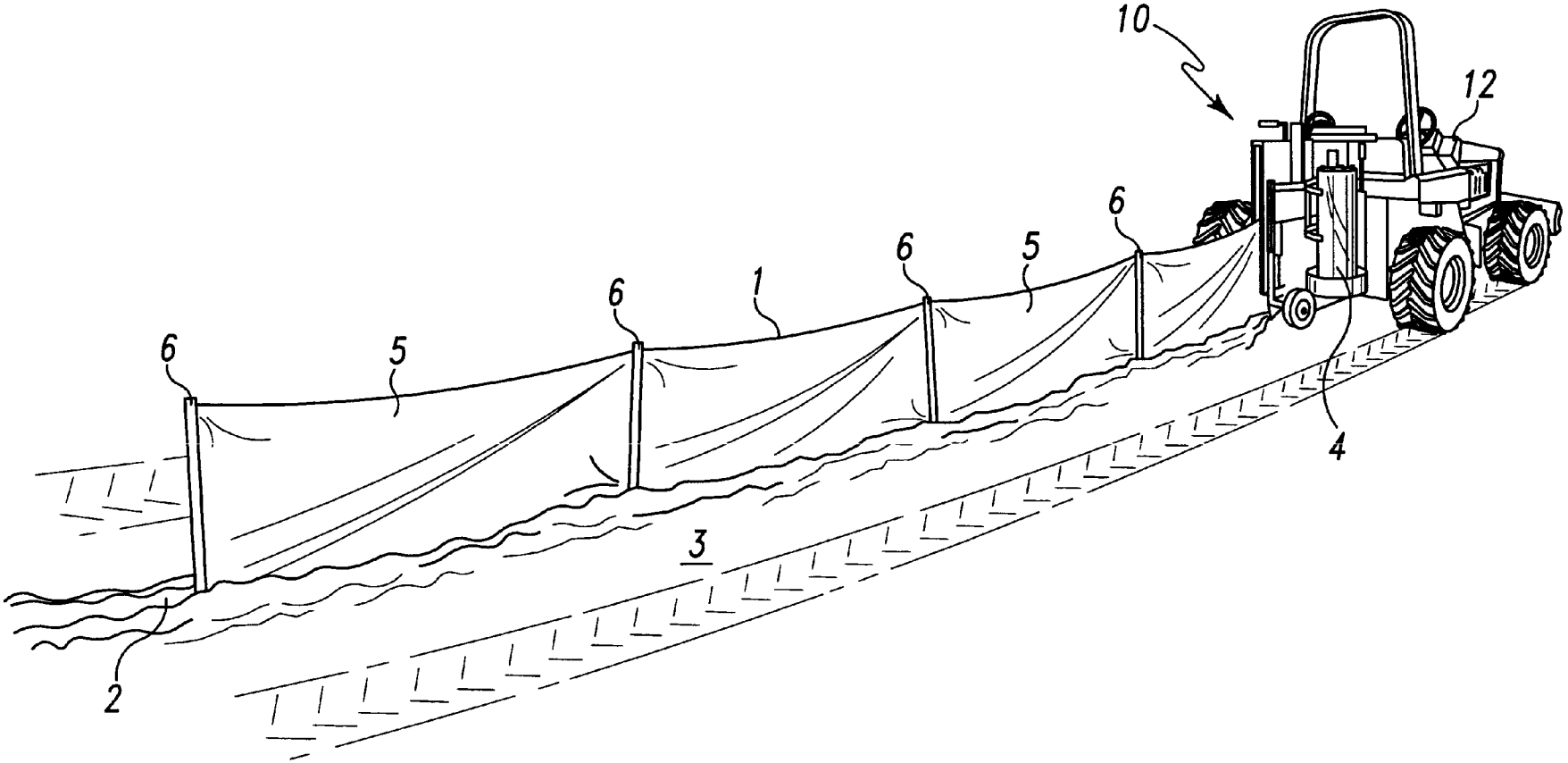
FIG. 1 is a perspective view of an apparatus for installing silt fence representing the present invention, depicted as mounted to a vehicle and illustrated with a section of installed silt fence.
Figure 2:
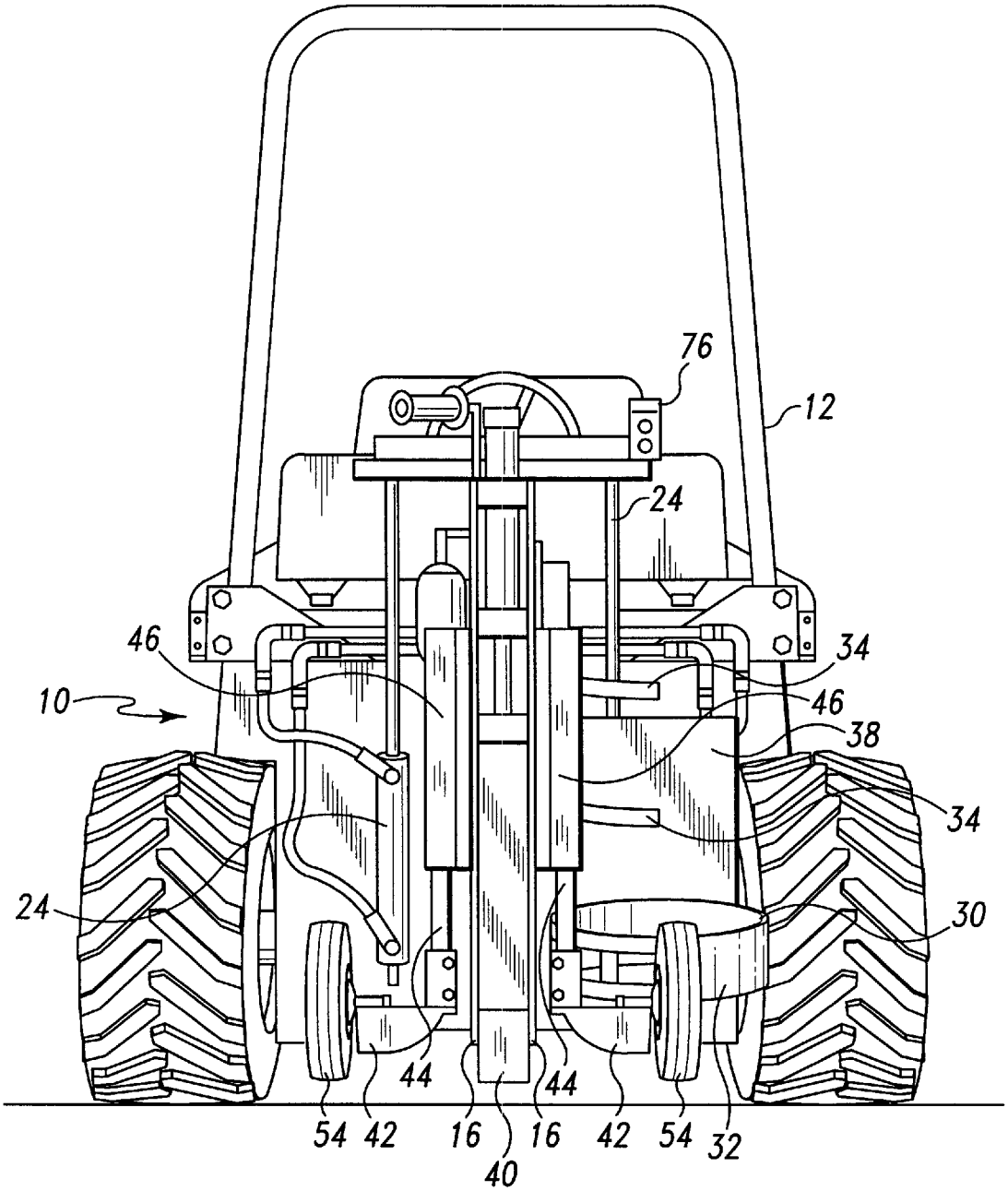
FIG. 2 is a rear elevation view of an apparatus for installing silt fence representing the present invention, depicted as mounted to a vehicle and illustrated as retracted above the soil.
Figure 3:
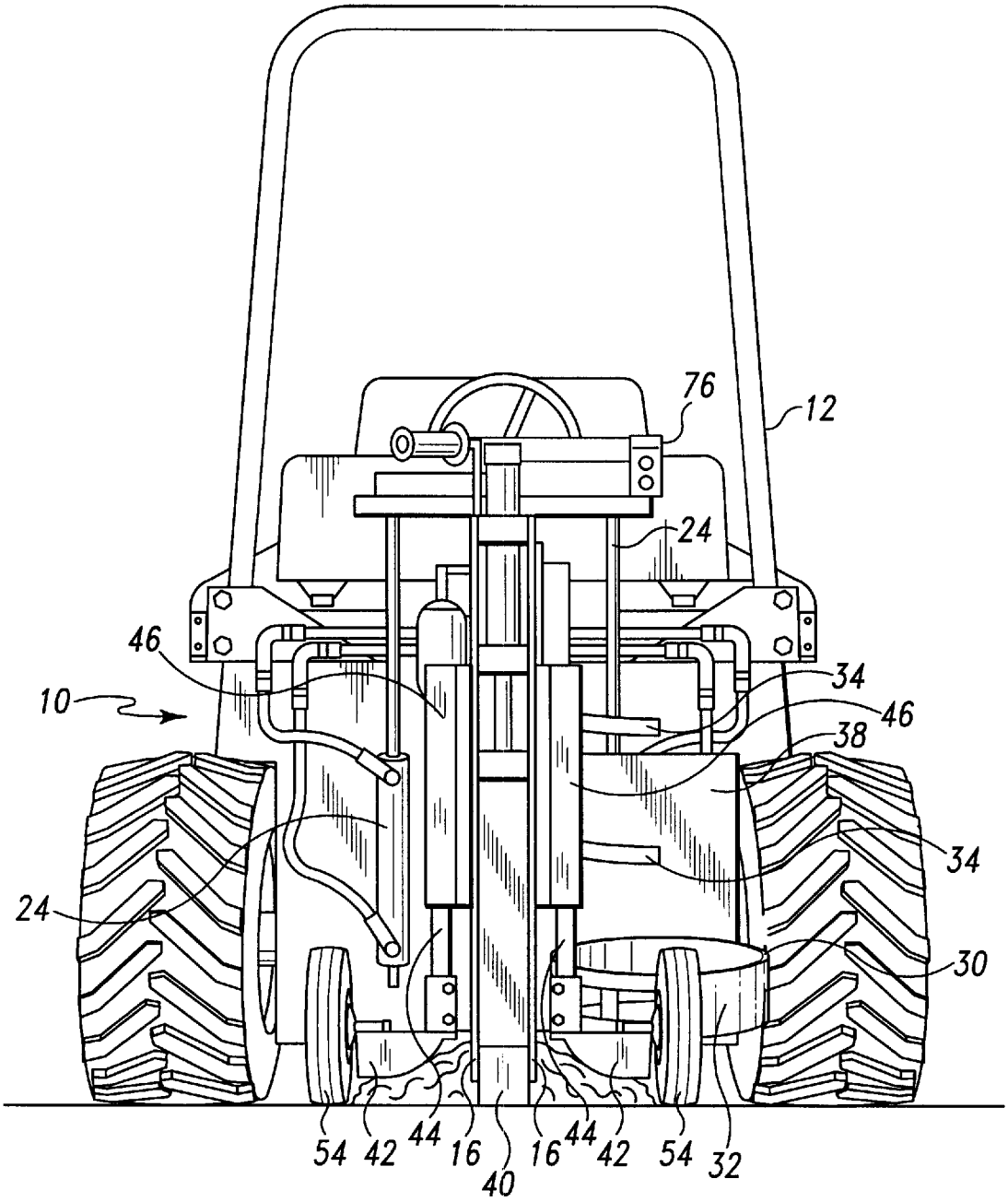
FIG. 3 is a rear elevation view of an apparatus for installing silt fence representing the present invention, depicted as mounted to a vehicle and illustrated as inserted into the soil.
Figure 4:
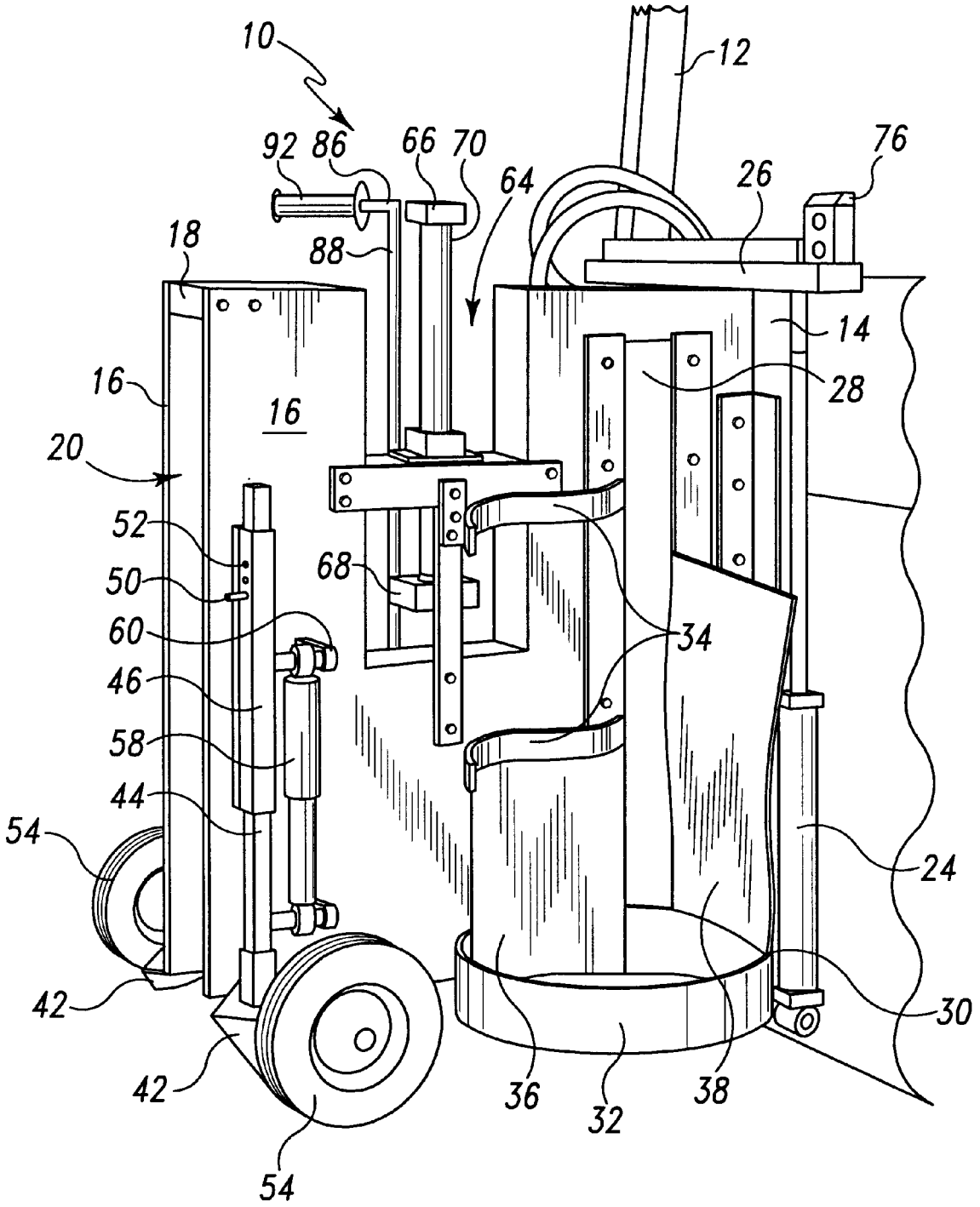
FIG. 4 is a perspective view of an apparatus for installing silt fence representing the present invention, depicted as mounted to a vehicle.
Figure 5:
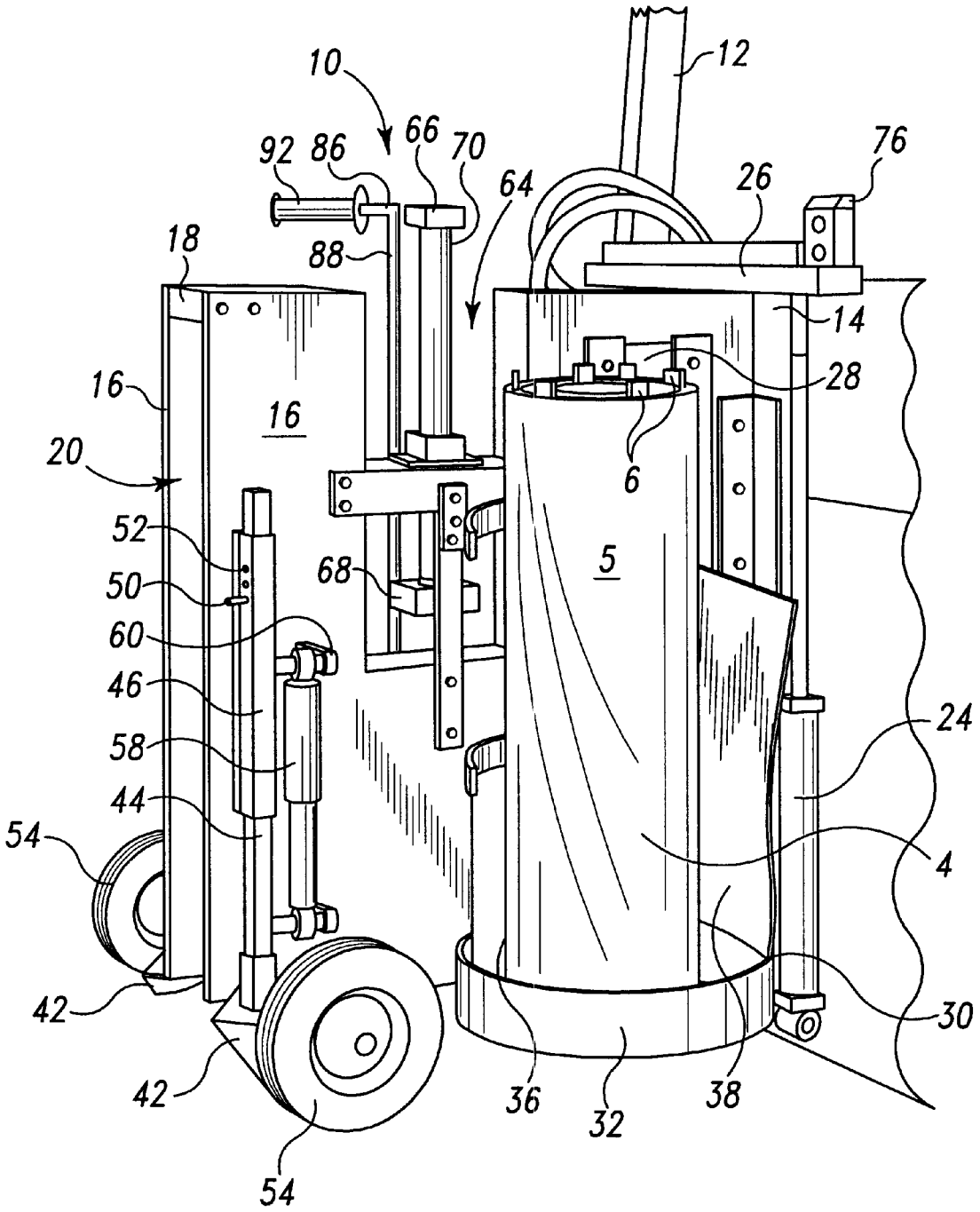
FIG. 5 is a perspective view of an apparatus for installing silt fence representing the present invention, depicted as mounted to a vehicle and illustrated with a roll of preassembled silt fence mounted thereon.
Figure 6:
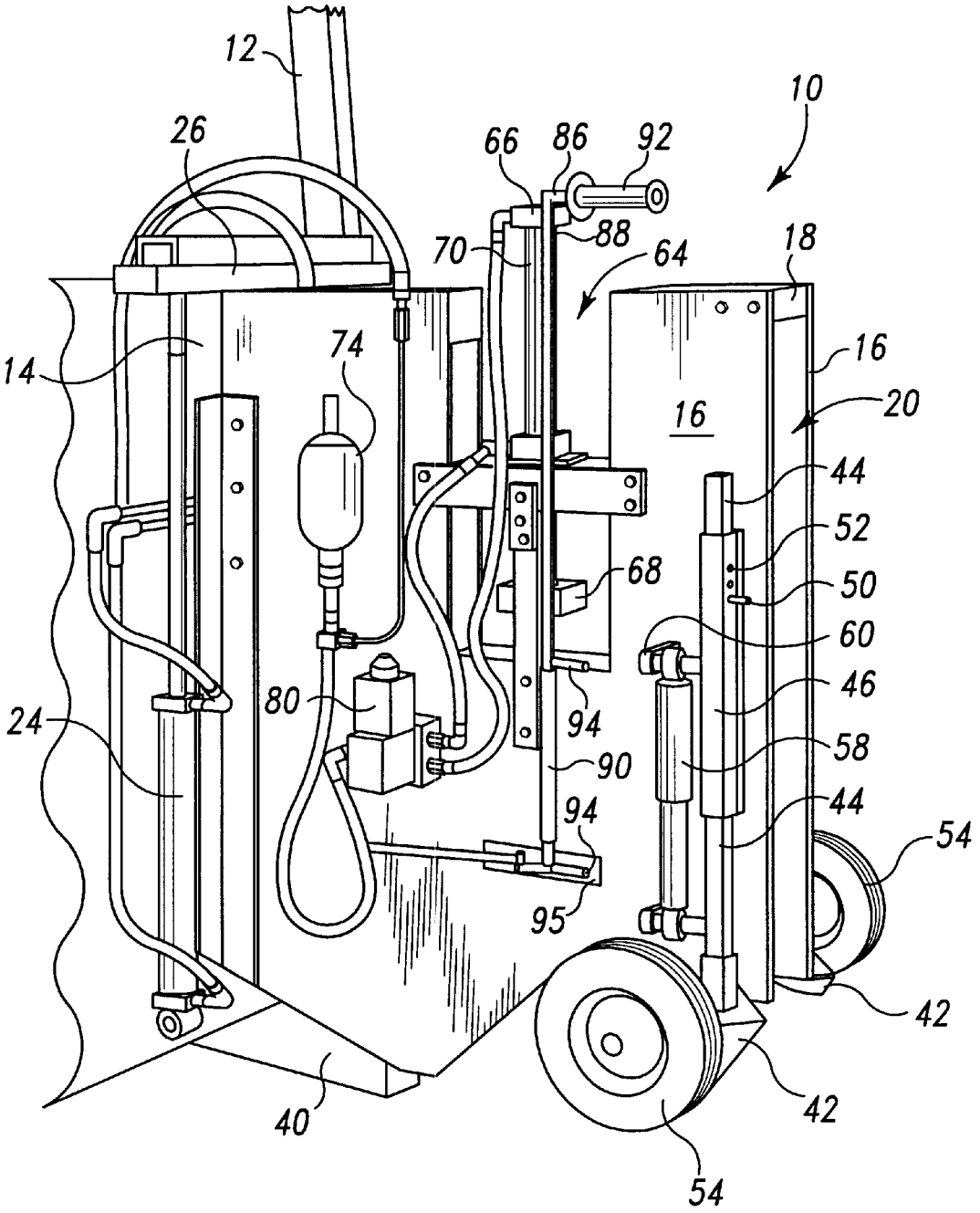
FIG. 6 is a perspective view of an apparatus for installing silt fence representing the present invention, depicted as mounted to a vehicle.
Figure 7:
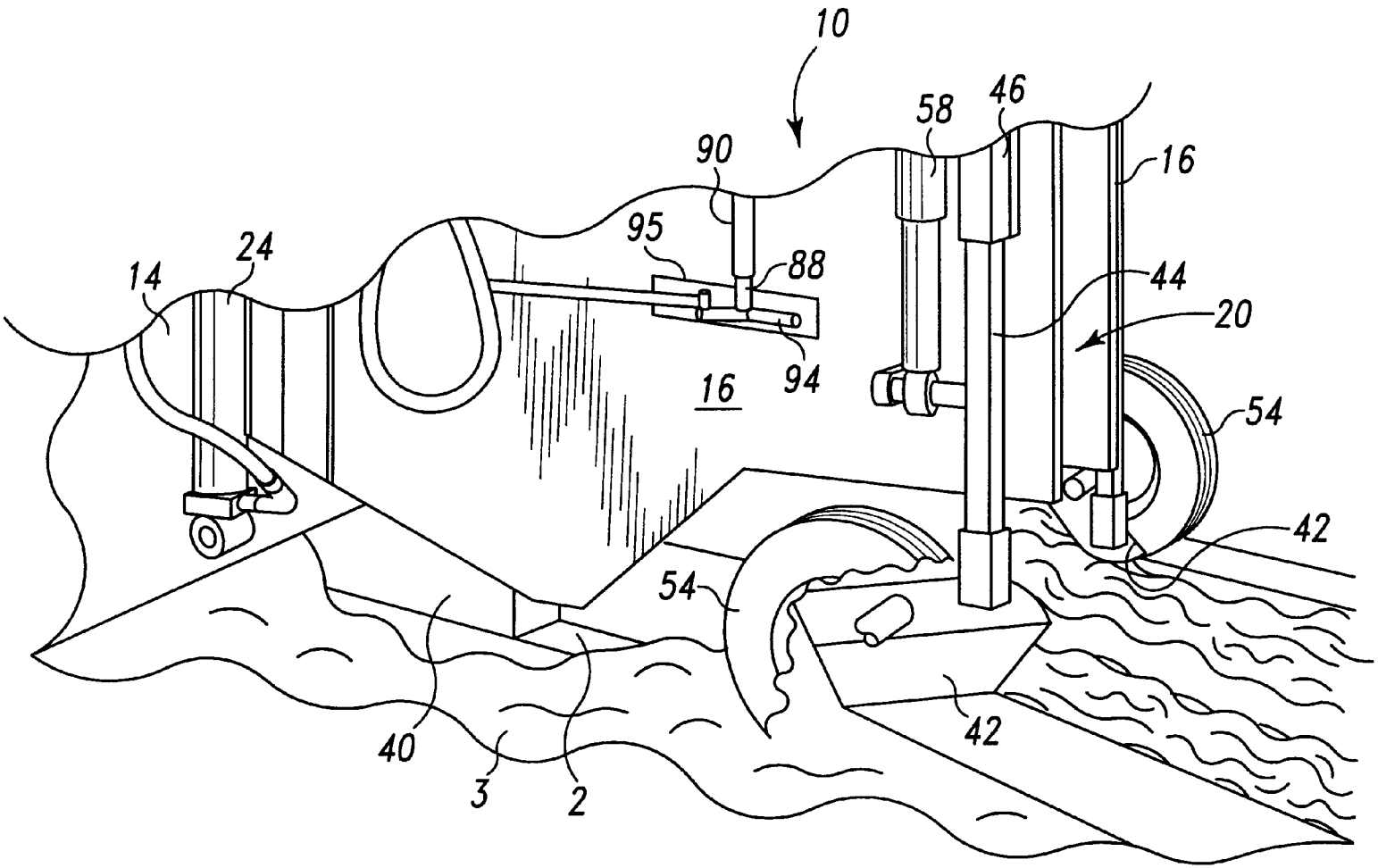
FIG. 7 is an enlarged partial perspective cutaway view of an apparatus for installing silt fence representing the present invention, illustrated as inserted into the soil.
Figure 8:
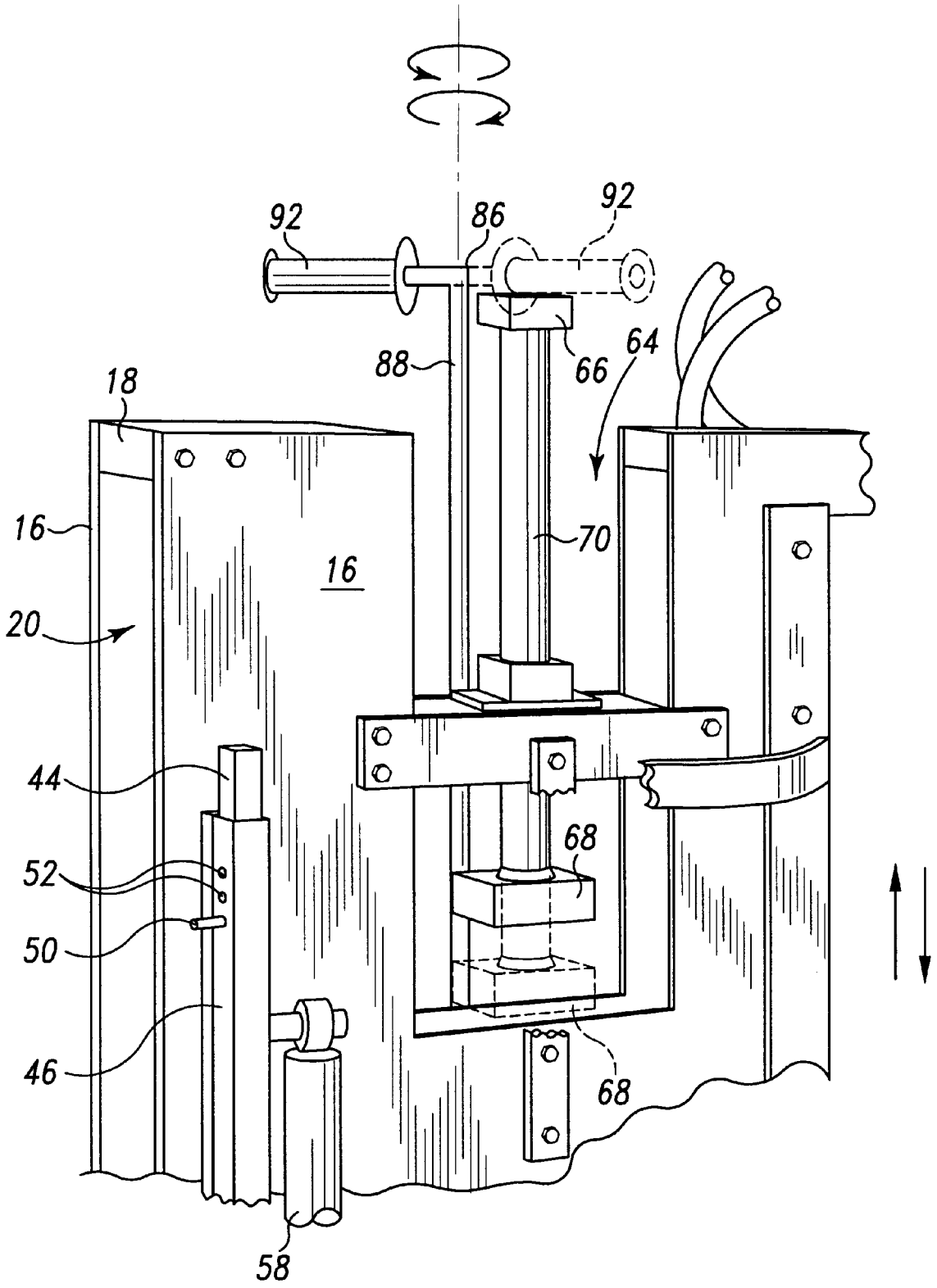
FIG. 8 is an enlarged partial perspective cutaway view of an apparatus for installing silt fence representing the present invention, depicting in phantom the stake ram in the activated position and the stake positioner in the blocking position.
Figure 9:
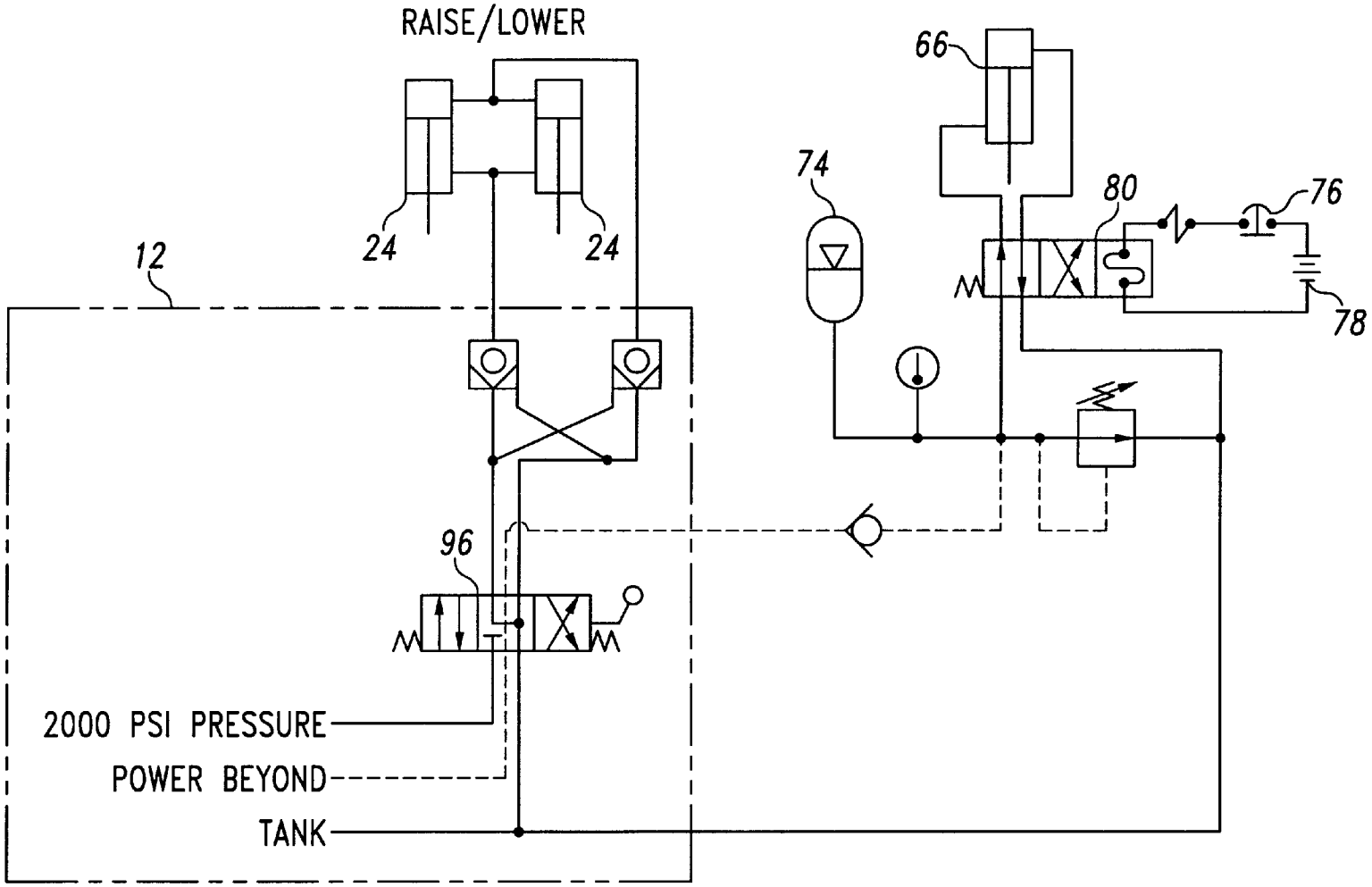
FIG. 9 is a hydraulic electrical block diagram schematically representing the hydraulic and electrical operation of the present invention.

Referring now to the drawings for a detailed description of the present invention, reference is first made to FIG. 1, generally depicting by the reference numeral 10 an apparatus for installing silt fence, disposed in attachment to tractor 12. Also illustrated in FIG. 1 is a section of silt fence 1 installed in trench 2 cut into soil 3. Silt fence 1 is preassembled into roll 4 and is formed of geotextile fabric 5 with attached stakes 6.

Although the apparatus of the present invention is shown as mounted to tractor 12, it will be understood that the apparatus for installing silt fence may be attached to any of a variety of other vehicles, within the scope of the present invention. In this regard, it will also be recognized that hydraulic and electrical power for operation of the apparatus for installing silt fence may be provided by tractor 12 or by other suitable vehicles, or may be provided by hydraulic and electrical power components of the apparatus of the present invention.

As shown in FIGS. 2–8, apparatus 10 includes end plate 14 mounted to rear portion of tractor 12. A pair of generally parallel guide plates 16 are slidably mounted generally perpendicular to end plate 14 for generally vertical reciprocating movement. Guide plates 16 are mounted together with separator 18, and define therebetween guide slit 20. Movement of guide plates 16 is controlled by a pair of hydraulic cylinders 24 mounted to end plate 14 and to guide cross member 26.

Silt fence roll holder 30 is mounted to one guide plate 16 proximate to rectangular aperture 28 defined therethrough. Roll holder 30 includes holder base 32, a pair of curved holder arms 34, shorter wall 36 and higher wall 38. Holder 30 may be mounted to guide plate 16 so that an axis defined by roll 4 is generally vertical, and unrolled silt fence 1 may pass through aperture 28 and into guide slit 20.

A trenching member, such as plow blade 40 is mounted to and between lower portions of guide plates 16, proximate to end plate 14. It will be recognized that a wide variety of trenching members can be utilized within the scope of the present invention, including plows having stationary blades, and apparatus having movable members such as multiple bucket, chain driven trenching devices. In addition, a backfill blade 42 is slidably mounted to the lower portion of each guide plate 16, distal from end plate 14 and plow blade 40, using backfill blade shafts 44 slidably disposed for generally vertical movement within brackets 46 mounted to the exterior of guide plates 16. Retraction of backfill blades 42 with respect to guide plate 16 is accomplished by disposing retaining pins 50 through retaining pin holes 52. As will be described, in use, retaining pins 50 are removed from retaining pin holes 52, permitting backfill blades 42 to move downward to contact the soil and backfill a trench cut by plow blade 40. During backfilling of soil, proper vertical height of backfill blades 42 is maintained by a wheel 54 mounted to each backfill blade 42. Movement of backfill blades 42 is damped by shock absorbers 58 mounted to backfill blade shafts 44 and to brackets 46 at shock absorber brackets 60.

As silt fence 1 unrolls from roll 4 and moves through guide slit 20, the attached stakes 6 reach a position with respect to guide plates 16 proximate to notch 64 defined by guide plates 16. Stake ram 66 is mounted to and between guide plates 16 at notch 64, for generally vertical reciprocating movement of stake ram base 68 mounted on hydraulic stake ram cylinder 70. Stake ram cylinder 70 is disposed in sealed fluid connection with hydraulic accumulator 74, which is in turn disposed in sealed fluid connection with the hydraulic system of tractor 12. Actuation of stake ram cylinder 70 is accomplished using fused push button assembly 76 electrically connected to tractor battery 78 and to solenoid 80, with speed of operation increased by the use of accumulator 74 disposed in sealed fluid connection with stake ram cylinder 70. In a most preferred embodiment, accumulator 74 may be of approximately 1 liter capacity and precharged with nitrogen at 1100 psi.

In order to position each stake 6 directly beneath stake ram base 68 for insertion into the soil, stake positioner 86 is mounted to a guide plate 16. Stake positioner 86 includes positioner shaft 88 rotatably disposed in mounting tube 90, with shaft handle 92 attached to the upper end of shaft 88 and a pair of spaced-apart positioning arms 94 projecting from shaft 88. By rotation of shaft handle 92, positioning arms 94 rotate generally horizontally into guide slit 20, through notch 64 and opening 95 defined through guide plate 16, thereby holding a stake 6 generally vertically and directly beneath stake ram base 68.

In use, tractor 12 is moved to a location where silt fence 1 is to be installed, with guide plates 16, plow blade 40, and backfill blades 42 disposed in a retracted position, that is, relatively elevated with respect to the soil. Upon arriving at the desired location, hydraulic control valve 96 is opened, and hydraulic cylinders 24 cause guide plates 16 and plow blade 40 to move downward so that plow blade 40 is inserted into the soil to create a trench of approximately 15 cm deep and 10 cm wide. A roll 4 is then placed onto roll holder 30, and silt fence 1 is unrolled and fed through aperture 28 and between guide plates 16 to trail out behind tractor 12. As tractor 12 travels, trench 2 is cut by plow blade 40, and silt fence 1 is immediately laid into the trench. When a stake 6, attached to unrolling fabric 5, reaches a position between guide plates 16 proximate to notch 64, shaft handle 92 is rotated to a blocking position so that positioning arms 94 block guide slit 20 with respect to further rearward movement of stake 6. With stake 6 thereby disposed generally vertically below stake ram base 68, push button assembly 76 is pressed, triggering solenoid 80 to rapidly activate stake ram 78, forcing stake 6 generally downward into the soil. Thereafter, stake ram 78 retracts and shaft handle 92 is returned to its original position, and additional silt fence 1 is permitted to trail out behind tractor 12 as tractor 12 travels and roll 4 rotates within roll holder 30. As succeeding stakes 6 becomes positioned below stake ram 66, each stake 6 is inserted into the soil in the same manner.

If desired, the soil displaced from trench 2 may be backfilled after installation of silt fence 1, by removing retaining pin 50 from retaining pin holes 52, to permit backfill blades 42 to move generally downward until wheels 54 are in contact with the soil. As tractor 12 travels, backfill blades 42 back fill soil displaced by plow blade 40 around installed silt fence 1.

Figure 10:
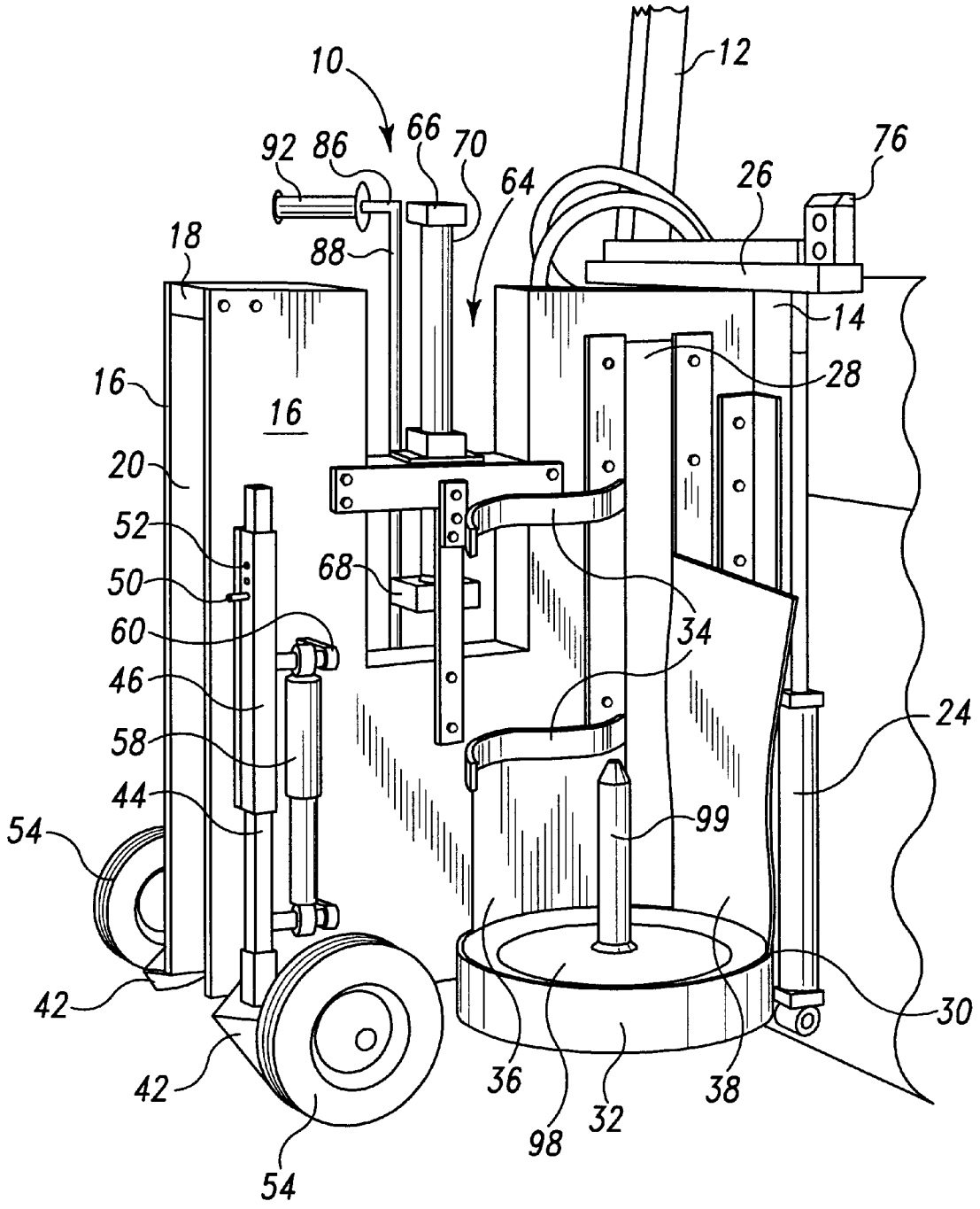
FIG. 10 is a perspective view of an apparatus for installing silt fence representing a second embodiment of the present invention, depicted as mounted to a vehicle.

In a second embodiment of the apparatus of the present invention, as illustrated in FIG. 10, roll holder 30 may further include rotatable carrier 98 having a spindle 99, disposed in holder base 32. Carrier 98 is rotatable with respect to holder base 32 about an axis defined by spindle 99, so that a roll 4 of silt fence 1 may be placed on carrier 98 over spindle 99, thereby facilitating rotation of roll 4 and unrolling of silt fence 1 as tractor 12 travels.

The present invention having been described in its preferred embodiments, it is clear that the present invention is susceptible to numerous modifications and embodiments within the ability of those skilled in the art and without the exercise of the inventive faculty. Accordingly, the scope of the present invention is defined as set forth by the scope of the following claims.

What is claimed is:

1. An apparatus for installing preassembled silt fence with attached stakes into soil, comprising:

a vehicle;

a holder mounted to vehicle and capable of holding a roll of preassembled silt fence with attached stakes for unrolling rotation about an axis defined by the roll;

a trenching member mounted to the vehicle for cutting a trench in the soil as the vehicle travels;

a guide mounted to the vehicle proximate to the holder, for guiding unrolled silt fence with attached stakes at least partially into the trench as the vehicle travels;

a stake ram mounted to the vehicle proximate to the guide for driving the attached stakes of the preassembled silt fence into the soil at the trench; and means for activating the stake ram when each stake reaches a predetermined position in the trench wherein the means for activating the stake ram includes hydraulic means coupled to the stake ram including a hydraulic accumulator for increasing speed of operation of the stake ram and an actuator for actuating the hydraulic means.

2. The apparatus for installing preassembled silt fence into soil as recited in claim 1, further comprising a backfill blade mounted to the vehicle and capable of backfilling displaced soil into the trench to at least partially surround the silt fence disposed in the trench, as the vehicle travels.

3. The apparatus for installing preassembled silt fence into soil as recited in claim 1, wherein the holder includes a rotatable carrier for holding the roll and rotating as the silt fence unrolls from the roll.

4. The apparatus for installing preassembled silt fence into soil as recited in claim 2, wherein the vehicle includes hydraulic pressure means coupled to the hydraulic means for providing hydraulic pressure to activate the stake ram.

5. The apparatus for installing preassembled silt fence into soil as recited in claim 4, wherein the trenching member is mounted to the vehicle for generally reciprocating movement for insertion into and retraction from the soil, and further comprising coupling means for coupling the trenching member to the hydraulic pressure means for producing reciprocating movement of the trenching member.

6. The apparatus for installing preassembled silt fence into soil as recited in claim 5 wherein:

the backfill blade is slidably mountable to the vehicle for reciprocating movement for insertion into and retraction from the soil.

7. The apparatus for installing preassembled silt fence into soil as recited in the claim 1, further comprising a backfill blade mounted to the vehicle and capable of backfilling displaced soil into the trench to at least partially surround the silt fence disposed in the trench, as the vehicle travels, and wherein the holder includes a rotatable carrier for holding the roll and rotating as the silt fence unrolls from the roll.

8. The apparatus for installing preassembled silt fence into soil as recited in claim 1, wherein the axis is generally vertical.

9. An apparatus for installing preassembled silt fence with attached stakes into soil and mountable to a vehicle comprising:

a holder mountable to the vehicle and capable of holding a roll of preassembled silt fence with attached stakes for unrolling rotation about an axis defined by the roll;

a trenching member mountable to the vehicle for cutting a trench in the soil as the vehicle travels;

a guide mountable to the vehicle proximate to the holder, for guiding unrolled silt fence with attached stakes at least partially into the trench as the vehicle travels;

a stake ram mountable to the vehicle proximate to the guide, for driving the attached stakes of the preassembled silt fence into the soil at the trench;

hydraulic means coupled to the stake ram including a hydraulic accumulator for increasing speed of operation of the stake ram, and an actuator for actuating the hydraulic means when each stake reaches a predetermined position in the trench.

10. The apparatus for installing preassembled silt fence into soil as recited in claim 9, further comprising a backfill blade mountable to the vehicle and capable of backfilling displaced soil into the trench to at least partially surround the silt fence disposed in the trench, as the vehicle travels.

11. The apparatus for installing preassembled silt fence into soil as recited in claim 9, wherein the holder includes a rotatable carrier for holding the roll and rotating as the silt fence unrolls from the roll.

12. The apparatus for installing preassembled silt fence into soil as recited in claim 9, further comprising a backfill blade mountable to the vehicle and capable of backfilling displaced soil into the trench to at least partially surround the silt fence disposed in the trench, as the vehicle travels, and wherein the holder includes a rotatable carrier for holding the roll and rotating as the silt fence unrolls from the roll.

13. The apparatus for installing preassembled silt fence into soil as recited in claim 12, wherein the hydraulic means may be coupled to a hydraulic pressure means of the vehicle to provide hydraulic pressure to activate the stake ram.

14. The apparatus for installing preassembled silt fence into soil as recited in claim 13, wherein the trenching member is mountable to the vehicle for generally vertical reciprocating movement for insertion into and retraction from the soil, and further comprising first coupling means capable of coupling the trenching member to the hydraulic pressure means for producing generally vertical reciprocating movement of the trenching member.

15. The apparatus for installing preassembled silt fence into soil as recited in claim 6, wherein:

the backfill blade is mountable to the vehicle for generally vertical reciprocating movement for insertion into and retraction from the soil; and further comprising second coupling means coupling the backfill blade to the hydraulic pressure means for producing generally vertical reciprocating movement of the backfill blade.

16. The apparatus for installing preassembled silt fence into soil as recited in claim 9, wherein the axis is generally vertical.

17. An apparatus for installing preassembled silt fence into soil, comprising:

a vehicle;

a holder mounted to vehicle and capable of holding a roll of preassembled silt fence with attached stakes for unrolling rotation about a vertical axis defined by the roll;

a trenching member mounted to the vehicle for cutting a trench in the soil as the vehicle travels;

a guide mounted to the vehicle proximate to the holder, for guiding unrolled silt fence with attached stakes at least partially into the trench as the vehicle travels;

a stake ram mounted to the vehicle proximate to the guide for driving the attached stakes of the preassembled silt fence into the soil at the trench; and means for activating the stake ram when each stake reaches a predetermined position in the trench, wherein the means for activating the stake ram includes hydraulic means coupled to the stake ram and an actuator for actuating the hydraulic means;

wherein the vehicle includes hydraulic pressure means coupled to the hydraulic means for providing hydraulic pressure to activate the stake ram;

further comprising coupling means for coupling the trenching member to the hydraulic pressure means for producing generally reciprocating movement of the trenching member for insertion into and retraction from the soil;

and a backfill blade slidably mounted to the vehicle for reciprocating movement for insertion into and retraction from the soil.

* * * * *